US006838642B2

(12) United States Patent
Richardot

(10) Patent No.: US 6,838,642 B2
(45) Date of Patent: Jan. 4, 2005

(54) THERMOFUSIBLE GLUE APPLICATOR WITH HEATING ELEMENT TRACK PRESSED AGAINST HEATING BODY

(75) Inventor: Francis Richardot, Le Val d'Ajol (FR)

(73) Assignee: Isaberg Rapid AB, Hestra (SE)

( * ) Notice: Subject to any disclaimer, the term of this patent is extended or adjusted under 35 U.S.C. 154(b) by 0 days.

(21) Appl. No.: 10/470,309

(22) PCT Filed: Jan. 31, 2002

(86) PCT No.: PCT/FR02/00369

§ 371 (c)(1),
(2), (4) Date: Jul. 29, 2003

(87) PCT Pub. No.: WO02/062491

PCT Pub. Date: Aug. 15, 2002

(65) Prior Publication Data

US 2004/0060665 A1 Apr. 1, 2004

(30) Foreign Application Priority Data

Feb. 2, 2001 (FR) ..... 01 01422

(51) Int. Cl.[7] ..... B05C 17/005; H05B 3/00

(52) U.S. Cl. ..... 219/229; 219/543; 222/146.5; 401/2

(58) Field of Search ..... 219/227–230, 219/543; 401/1, 2; 222/146.5

(56) References Cited

U.S. PATENT DOCUMENTS 4,032,046 A * 6/1977 Elliott et al. ..... 222/146.5
4,493,972 A * 1/1985 Steinel et al. ..... 219/230
4,938,388 A * 7/1990 Yeh ..... 222/146.5
6,142,207 A 11/2000 Richardot
6,376,816 B2 * 4/2002 Cooper et al. ..... 219/543
6,527,143 B1 * 3/2003 Schomacker ..... 222/146.5

FOREIGN PATENT DOCUMENTS

DE 2854230 * 3/1980
EP 76735 * 4/1983
FR 2565131 * 12/1985 ..... 219/230

OTHER PUBLICATIONS

Preliminary Search Report dated Oct. 2, 2001.
International Search Report dated Jun. 5, 2002.

* cited by examiner

*Primary Examiner*—John A. Jeffery
(74) *Attorney, Agent, or Firm*—Stevens, Davis, Miller & Mosher, LLP

(57) ABSTRACT

The invention relates to an applicator comprising a) an elongated chamber (3) having an opening for a glue stick and a nozzle (6) for distributing melted glue, b) means for gradually pushing the stick into the chamber (3) and c) two heating elements ($\mathbf{13_1}$, $\mathbf{13_2}$), each of which comprises a channel ($\mathbf{15_1}$, $\mathbf{15_2}$) made from an electrically resistant material and which can be connected to an electrical power source. Said channel ($\mathbf{15_1}$, $\mathbf{15_2}$) is formed on an electrically insulated surface of a substrate ($\mathbf{14_1}$, $\mathbf{14_2}$) which is arranged so as to be in thermal contact with a mass of glue contained in the chamber (3). The heating element ($\mathbf{13_1}$, $\mathbf{13_2}$) is applied against an external conformal surface ($\mathbf{2_1}$, $\mathbf{2_2}$) of a heating body (2), one surface of which defines said chamber (3). The heating body (2) is made from a heat-conducting material.

10 Claims, 1 Drawing Sheet

THERMOFUSIBLE GLUE APPLICATOR WITH HEATING ELEMENT TRACK PRESSED AGAINST HEATING BODY

FIELD OF THE INVENTION

The present invention relates to a hot melt glue applicator and more particularly to an applicator of the type disclosed in U.S. Pat. No. 6,142,207, assigned to SOFRAGRAF INDUSTRIES, which applicator is shown diagrammatically in axial section in FIG. 1 of the appended drawing.

BACKGROUND OF THE RELATED ART

The figure shows that the applicator generally takes the form of a pistol and comprises a casing 1 enclosing a tubular heating body 2 through which passes an elongate chamber 2 having a first end 4 shaped as an inlet for a stick B of hot melt glue and a second end 5 equipped with a molten glue dispenser nozzle 6. The applicator further includes means (not shown) for pushing the stick B progressively into a bush 7 coaxial with the chamber 3 and then into the chamber, and electrical means for heating the portion of the glue stick that is pushed into the chamber.

The applicator further comprises a handle 8 equipped with a trigger 9 for operating the means for pushing the stick, which means can comprise a mechanical transmission using a linkage or a rack, for example. This is well known in the art.

The electrical means for heating the mass of glue contained in the chamber 3 are supplied with power via electrical wires 10 connected to a terminal block $\mathbf{11}_1$ of a circuit 11 for regulating the power supply to the heating means. The circuit 11 is itself supplied with electrical power via a cable 12 connected to a terminal block $\mathbf{11}_2$ of the circuit 11 and to the AC mains. Alternatively, the circuit 11 could also be supplied with power by a storage battery internal or external to the applicator.

According to the U.S. patent previously cited, the heating means comprise one or more heating elements each comprising a track of a material with a high electrical resistance and provided with means for connecting it to an electrical power supply, the track being formed on an electrically insulative surface of a substrate arranged to be in thermal contact with the mass of glue contained in the chamber 3.

This kind of flat heating element can be produced using means usually employed for the fabrication of thick film hybrid circuits, which comprise a substrate of alumina, enameled sheet metal, or stainless steel sheet, for example, covered with a dielectric, a track in the form of a paste being screenprinted onto the substrate and, after drying, constituting a resistive "ink" adapted to heat an adjacent mass of glue by the Joule effect and thermal conduction, when an electrical current flows through it.

These heating elements have many advantages over the electrical heating means conventionally used in hot melt glue applicators. They heat up very quickly, because of their low thermal inertia. Their heating power per unit surface area is very high. Furthermore, screenprinting allows great variation in the design of the tracks. This facilitates the adaptation of such heating elements to specific or new requirements.

The patent previously cited describes various embodiments of a hot melt glue applicator equipped with the above kind of heating elements, in which the elements line all or part of the wall of the chamber 3, to establish optimum thermal contact with the mass of glue contained in the chamber. The heating body 2 is made from a thermally insulative material in this case.

This arrangement of the heating elements nevertheless has disadvantages. Apart from the fact that they are inconvenient to install, supplying electrical power to them requires holes in the heating body for the power supply wires to pass through, which holes can give rise to leakage of the glue, especially if the wires also pass through the substrate of the heating element. If the latter is made of metal, the passage of the wires further gives rise to problems of electrically insulating the wires from the substrate. Finally, if the screen-printed tracks face the mass of glue contained in the chamber 3, care must be taken to ensure that the spot welds connecting the electrical power supply wires to the tracks do not impede the movement of the mass of glue in the chamber.

SUMMARY OF THE INVENTION

Thus an object of the present invention is to provide a hot melt glue applicator that does not have the disadvantages referred to above and which in particular includes a heating body that is perfectly sealed with respect to the molten glue, the heating elements being very easy to install.

The above objects of the invention, together with others that will become apparent on reading the following description, are achieved by a hot melt glue applicator comprising a) an elongate chamber having a first end conformed as an inlet for a stick of said hot melt glue and a second end equipped with a nozzle for dispensing molten glue, b) means for progressively pushing said stick into said chamber, and c) electrical means for heating the portion of the stick contained in the chamber, said heating means comprising at least one heating element consisting of at least one track of an electrically resistive material and provided with means for connecting it to an electrical power supply, said track being formed on an electrically insulative surface of a substrate, said substrate being adapted to be in thermal contact with a mass of glue contained in said chamber. The applicator is noteworthy in that said heating element is pressed tightly against a conformal exterior facet of a heating body an interior surface of which delimits said chamber, the heating body being made from a thermally conductive material.

As explained in more detail later, by disposing the heating element(s) of the applicator in this way, excellent thermal contact is maintained between the elements and the mass of glue to be heated, through the thermally conductive material of the heating body, whilst eliminating the passage of the electrical power supply wires of the heating elements through the body, and thus any possibility of glue leaking. Furthermore, the position of the heating elements against the exterior surface of the heating body greatly facilitates their installation.

According to other features of the hot melt glue applicator according to the invention, the substrate can be an insulated metal substrate. In this case, the track formed on the substrate can be disposed on the face of said substrate opposite that pressed against the heating body. The heating element can also include at least two electrically resistive material tracks each disposed on one of the two faces of the substrate of the heating element.

The substrate can also be made from an electrically insulative material.

BRIEF DESCRIPTION OF THE DRAWING

Other features and advantages of the glue applicator according to the present invention will become apparent on reading the following description and examining the accompanying drawing, in which.

DETAILED DESCRIPTION OF THE INVENTION

Figure 1:
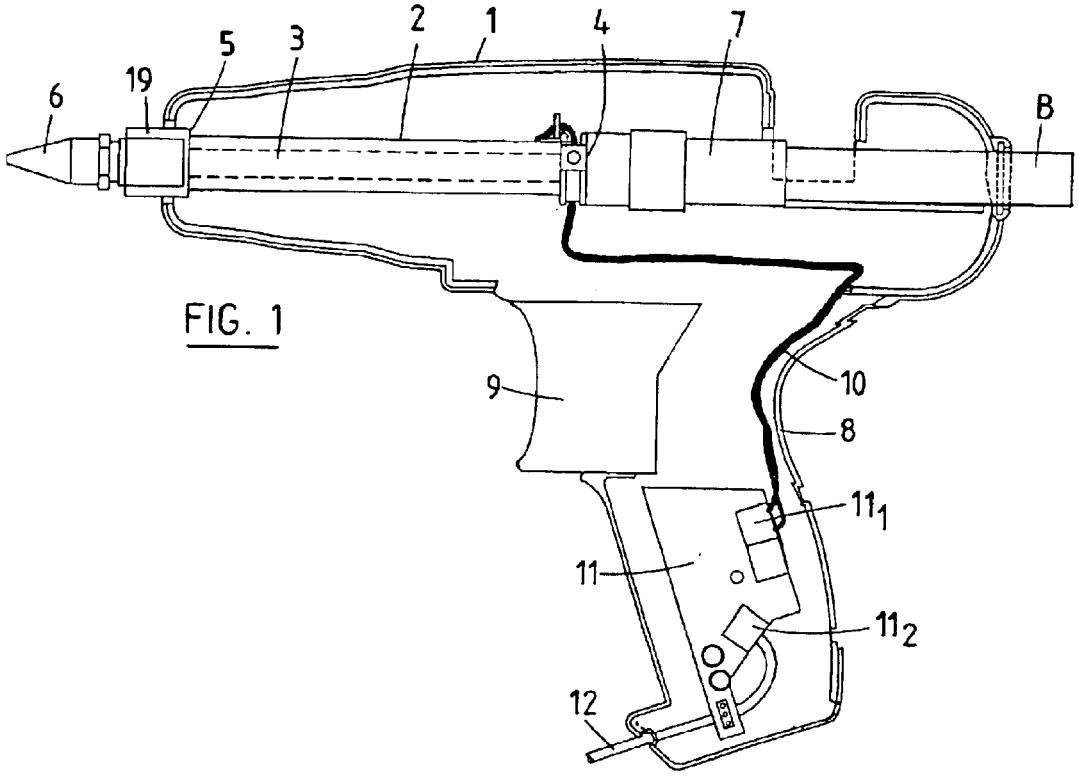
FIG. 1 is a diagrammatic view in axial section of a hot melt glue applicator according to the invention, prior art features of which are described in the preamble of this description.
Figure 2:
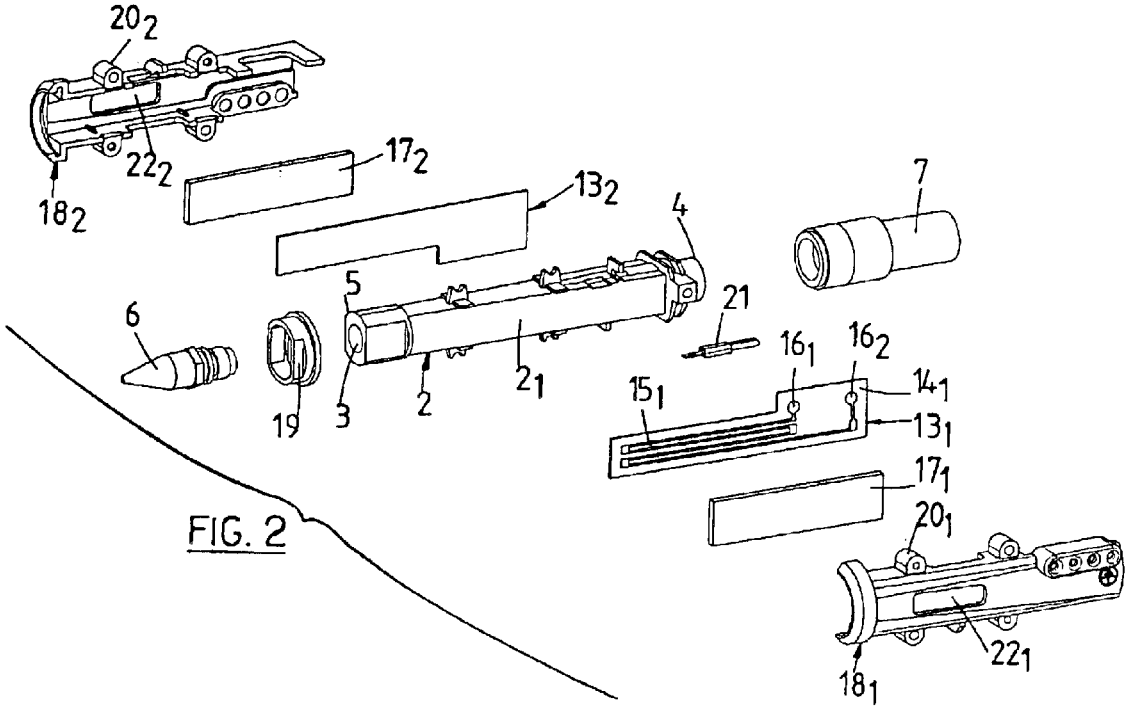
FIG. 2 is an exploded partial view of the FIG. 1 applicator, showing the heating body of the applicator and various components associated with it.

FIG. 2 shows the components shown in FIG. 1, namely the pierced heating body 2 of the chamber 3 extended at one end by the nozzle 6 and at the other end by the bush 7.

The heating body 2 has an exterior surface conformed to receive, in intimate contact with it, two heating elements $\mathbf{13}_1$, $\mathbf{13}_2$ on two opposite plane facets $\mathbf{2}_1$, $\mathbf{2}_2$ of the exterior surface (only the facet $\mathbf{2}_1$ can be seen in FIG. 2). An interior surface of the heating body delimits the chamber 3.

The two heating elements are identical and each comprises a substrate $\mathbf{14}_1$, $\mathbf{14}_2$ with at least one face covered by a screenprinted track, such as the track $\mathbf{15}_1$ visible on the substrate $\mathbf{14}_1$ of the heating element $\mathbf{13}_1$.

The heating elements are of the type described in the U.S. patent previously cited, formed of a plane substrate on which is screenprinted a resistive paste or "ink" tracing the track $\mathbf{15}_1$, using the technology employed for fabricating thick film hybrid circuits. Reference may also be made to the U.S. patent previously cited for more details on materials suitable for the substrate and the tracks of the heating elements.

Weld areas $\mathbf{16}_1$, $\mathbf{16}_2$ connect the track to the electrical power supply wires 10. Because the heating elements are outside the heating body 2, these weld areas are connected to the power supply wire 10 without the wires passing through holes pierced in the body, which eliminates the risk of glue leaking through such holes.

In the FIG. 2 exploded view, it is apparent that the tracks $\mathbf{14}_1$, $\mathbf{14}_2$ are formed on the faces of the substrates of the respective elements $\mathbf{13}_1$, $\mathbf{13}_2$ that face outward, relative to the heating body 2, and therefore on the faces of the substrates that are opposite those pressed against the heating body 2. The substrates must therefore be made from a material that is a good conductor of heat (enameled sheet metal or stainless steel sheet covered with a dielectric), for example using the insulated metal substrate (IMS) technology, so that heat radiated by the track can be transmitted by conduction to the heating body via the substrates. This disposition of the heating element tracks facilitates electrical insulation of the track from the heating body 2.

Both faces of each substrate are electrically insulated by any appropriate means (glass film, etc.).

The heating body 2 is made from a material that is a good conductor of heat, such as diecast aluminum, for example.

The heating elements $\mathbf{13}_1$, $\mathbf{13}_2$ are pressed onto the facing plane facets $\mathbf{2}_1$, $\mathbf{2}_2$ of the exterior surface of the heating body 2 (only the facet $\mathbf{2}_1$ is visible in FIG. 2). The heating elements are held in intimate contact with the facets by clamping them between the latter and heat shields $\mathbf{17}_1$, $\mathbf{17}_2$. The latter are in turn clamped by two half-shells $\mathbf{18}_1$, $\mathbf{18}_2$ of a casing which, in conjunction with a ring 19 slipped over the end 5 of the heating body 2, hold together all the components associated with the heating body, self-tapping screws, such as the screws $\mathbf{20}_1$, $\mathbf{20}_2$, being screwed into pairs of complementary holes formed in the half-shells.

A temperature sensor 21 is mounted on the heating body, in thermal contact therewith, to produce a signal representative of the temperature of the body. The sensor 20 is connected to the regulator circuit 11 to deliver to that circuit a signal representative of that temperature, which signal is necessary for closed loop regulation of the temperature of the mass of glue contained in the chamber 3.

The glue applicator in accordance with the invention described above operates in the following manner. When the tracks of the heating elements $\mathbf{13}_1$, $\mathbf{13}_2$ are supplied with electrical current and a stick of hot melt glue is pushed into the chamber 3 of the body 2, the heat radiated by the Joule effect by the heating elements is blocked on one side by the heat screens $\mathbf{17}_1$, $\mathbf{17}_2$ and transmitted on the other side to the heating body 2 via the substrates of the heating elements, consisting of sheet metal a few tenths of a millimeter thick, for example. The heat propagated in this way propagates directly and completely into the heating body, which is made of aluminum, for example, thanks to the intimate physical contact established between the exterior surface of the heating body 2 and the heating elements $\mathbf{13}_1$, $\mathbf{13}_2$.

Thanks to the high thermal conductivity of the aluminum body, the heat transmitted is distributed throughout the mass of glue contained in the chamber 3, thereby ensuring uniform heating of all parts thereof.

This is an additional advantage of the glue applicator according to the invention. In the applicator described in the U.S. patent previously cited, the heating elements essentially heat the portions of the glue in contact with them, the heat transmitted in this way diffusing with difficulty because of the poor thermal conductivity of the glue.

The uniform heating achieved by the applicator according to the invention heats the hot melt glue to the viscosity required for the glue to be dispensed via the nozzle 6, with the temperature controlled by the circuit 11.

Windows $\mathbf{22}_1$, $\mathbf{22}_2$ can be provided in the respective half-shells $\mathbf{18}_1$, $\mathbf{18}_2$ to ventilate the heat shields $\mathbf{17}_1$, $\mathbf{17}_2$ to prevent degradation thereof.

It is now apparent that the present invention achieves the stated objects, namely to provide efficient heating of the heating body and therefore of the glue with "thick film hybrid circuit" type heating element adapted to avoid all piercing of the heating body and to facilitate their installation thereon.

Of course, the invention is not limited to the embodiment described and shown, which are given by way of example only. Thus the temperature sensor could be mounted on one of the heating elements, for example, rather than on the heating body, the thick film hybrid circuit lending itself to carrying discrete components. The sensor could even take the form of an ink track whose resistance is a function of temperature, carried directly by the substrate of the heating element.

Both faces of the same metal substrate could carry resistive ink tracks to increase the quantity of heat radiated by the same heating element.

The heating body could receive a number of heating elements other than two, depending on the required heating power, for example.

The regulation circuit could also be replaced by the use of a positive temperature coefficient ink for the resistive track of the heating element.

The substrate of the heating elements could be an electrically insulative material, such as alumina, which conducts heat less well than metal.

In this case, the tracks $15_1$, $15_2$ could face toward the heating body and be appropriately insulated therefrom, for example by a layer of glass or mica.

The heating elements could also be curved rather than plane, in which case they could then be applied to conformal curved surfaces of the heating body.

What is claimed is:

1. A hot melt glue applicator comprising a) an elongate chamber having a first end conformed as an inlet for a stick of said hot melt glue and a second end equipped with a nozzle for dispensing molten glue, b) means for progressively pushing said stick into said chamber, and c) electrical means for heating the portion of the stick contained in the chamber, said heating means comprising at least one heating element comprising at least one track of an electrically resistive material and provided with means for connecting said track to an electrical power supply, said track being formed on an electrically insulative surface of a substrate, said substrate being adapted to be in thermal contact with a mass of glue contained in said chamber, wherein said heating element is pressed tightly against a conformal exterior facet of a heating body an interior surface of which delimits said chamber, said heating body being made from a thermally conductive material.

2. An applicator according to claim 1, wherein said substrate is an insulated metal substrate.

3. An applicator according to claim 2, wherein the track formed on said substrate is disposed on the face of said substrate opposite that pressed against said heating body.

4. An applicator according to any one of claims 1 to 3, wherein said heating element includes at least two electrically resistive material tracks each disposed on one of the two faces of the substrate of the heating element.

5. An applicator according to claim 1, wherein said substrate is made from an electrically insulative material.

6. An applicator according to claim 1, wherein the material constituting the resistive track or tracks has a positive temperature coefficient.

7. An applicator according to claim 1, further comprising electronic means for regulating the temperature of the heated mass of glue.

8. An applicator according to claim 7, further comprising a sensor for sensing the temperature of said heating body to deliver a signal representative of said temperature to said regulation means.

9. An applicator according to claim 8, wherein said sensor is disposed on the substrate of said heating element.

10. An applicator according to claim 1 wherein the resistive track carried by each heating element is made by screenprinting a resistive paste onto the substrate using the thick film hybrid circuit fabrication technology.

* * * * *